US009488374B2

(12) United States Patent
Vancak

(10) Patent No.: US 9,488,374 B2
(45) Date of Patent: Nov. 8, 2016

(54) SUPPORT SYSTEM FOR RADIANT TUBE HEATERS

(71) Applicant: John Vancak, Calgary (CA)

(72) Inventor: John Vancak, Calgary (CA)

( * ) Notice: Subject to any disclaimer, the term of this patent is extended or adjusted under 35 U.S.C. 154(b) by 306 days.

(21) Appl. No.: 13/815,337

(22) Filed: Feb. 22, 2013

(65) Prior Publication Data

US 2014/0242528 A1 Aug. 28, 2014

Related U.S. Application Data

(62) Division of application No. 11/248,215, filed on Oct. 13, 2005, now abandoned.

(51) Int. Cl.

| | |
|---|---|
| ***A47B 81/00*** | (2006.01) |
| ***F23N 5/08*** | (2006.01) |
| ***F23C 5/02*** | (2006.01) |
| ***F23D 14/12*** | (2006.01) |

(52) U.S. Cl.

CPC . *F23N 5/08* (2013.01); *F23C 5/02* (2013.01); *F23D 14/12* (2013.01); *F23N 5/082* (2013.01); *F23N 2033/08* (2013.01); *F23N 2035/16* (2013.01)

(58) Field of Classification Search

CPC ..... F23C 5/02
USPC ..... 431/37; 211/26; 126/92 AC
See application file for complete search history.

(56) References Cited

U.S. PATENT DOCUMENTS

| | | | | | |
|---|---|---|---|---|---|
| 3,351,048 | A * | 11/1967 | Fannon, Jr. | 126/92 R | |
| 3,399,833 | A * | 9/1968 | Johnson | 237/53 | |
| 3,606,028 | A * | 9/1971 | Klein | A47B 57/30 | 211/191 |
| 4,313,688 | A * | 2/1982 | Daniels | E04B 1/2608 | 403/189 |
| 4,390,125 | A * | 6/1983 | Rozzi | F23N 5/245 | 126/92 AC |
| 4,979,491 | A * | 12/1990 | DeMeritt | 126/92 B | |
| 5,419,089 | A * | 5/1995 | Hill | E04B 1/24 | 52/656.9 |
| 2006/0081238 | A1 * | 4/2006 | Vancak | 126/92 AC | |

* cited by examiner

*Primary Examiner* — Avinash Savani
(74) *Attorney, Agent, or Firm* — George A. Seaby

(57) ABSTRACT

A modular support system for outdoor radiant tube heaters includes a frame defined by hollow beams for receiving fuel and electrical lines and supporting electrical heaters posts for supporting the beams and saddles for interconnecting the beams and mounting them on posts.

6 Claims, 5 Drawing Sheets

SUPPORT SYSTEM FOR RADIANT TUBE HEATERS

CROSS REFERENCE TO RELATED APPLICATION

This is a divisional of application Ser. No. 11/248,215 filed Oct. 13, 2005. This application claims priority on U.S. Provisional Application 60/618,164 filed Oct. 14, 2004.

BACKGROUND OF THE INVENTION

1. Field of the Invention

This invention relates to a support system for a radiant heater assembly and in particular to a radiant heating assembly support system for outdoor use.

2. Discussion of the Prior Art

In general, there are several drawbacks to currently available outdoor radiant tube heater assemblies. Most outdoor patios do not have an overhead structure for the installation of heaters. At present, overhead patio heaters require an awning, roof or a custom made support system for installation. Custom made support systems require on-site cutting, welding and fabrication of material to build an assembly of sufficient structural integrity to support heaters and withstand the elements of nature. Some patio heaters include post mounted "mushroom" style heaters attached to tubes, which are embedded in concrete or surface mounted on a patio. Disadvantages of these types of structures are that a tube or post is required for every heater, taking up space on a patio. Moreover, gas and/or electrical lines include underground pipes and conduits. During new construction, supply lines must be buried prior to the installation of the patio surface. In the case of an installation on an existing patio, the patio surface must be demolished to an extent sufficient to permit installation of underground fuel and/or electrical supply lines which is a costly undertaking.

GENERAL DESCRIPTION OF THE INVENTION

An object of the present invention is to provide a modular support system for radiant patio heaters which is easy to assemble on site, and which can readily be secured to existing patio surfaces using standard, readily available fasteners.

According to one aspect the invention relates to a variable input, radiant tube heater comprising a housing; a burner in said housing; a reflector connected to said housing; a burner tube in said housing; a gas inlet line for introducing, fuel into said burner; a blower attached to said housing for blowing air into said housing; a 24 volt motor in said blower for operating the blower; a gas pressure regulator in said gas inlet line for regulating the flow of fuel to the burner; and a transformer remote from said heater for supplying 24 volt power to said blower motor.

According to another aspect, the invention relates to a variable input, radiant tube heater comprising a housing; a burner in said housing, a reflector connected to said housing; a burner tube in said housing; a gas inlet line for introducing fuel into said burner; a blower attached to said housing for blowing air into said housing; a gas pressure regulator in said gas inlet line for regulating the flow of fuel to the burner; said regulator including a valve in said gas inlet line, and a valve operator for opening and closing said valve; and an electrical control connected to said valve operator for controlling operation of said valve operator.

According to yet another aspect the invention relates to a modular support system for outdoor radiant heaters comprising a frame including at least one hollow beam for receiving fuel and electrical lines and supporting a radiant heater; a plurality of posts for supporting said beam at ends thereof; and saddles for connecting said beam to said posts, each said saddle having a closed bottom plate, side plates and an open top end.

BRIEF DESCRIPTION OF THE DRAWINGS

The invention is described below in greater detail with reference to the accompanying drawings, wherein.

DESCRIPTION OF THE PREFERRED EMBODIMENT

Figure 1:
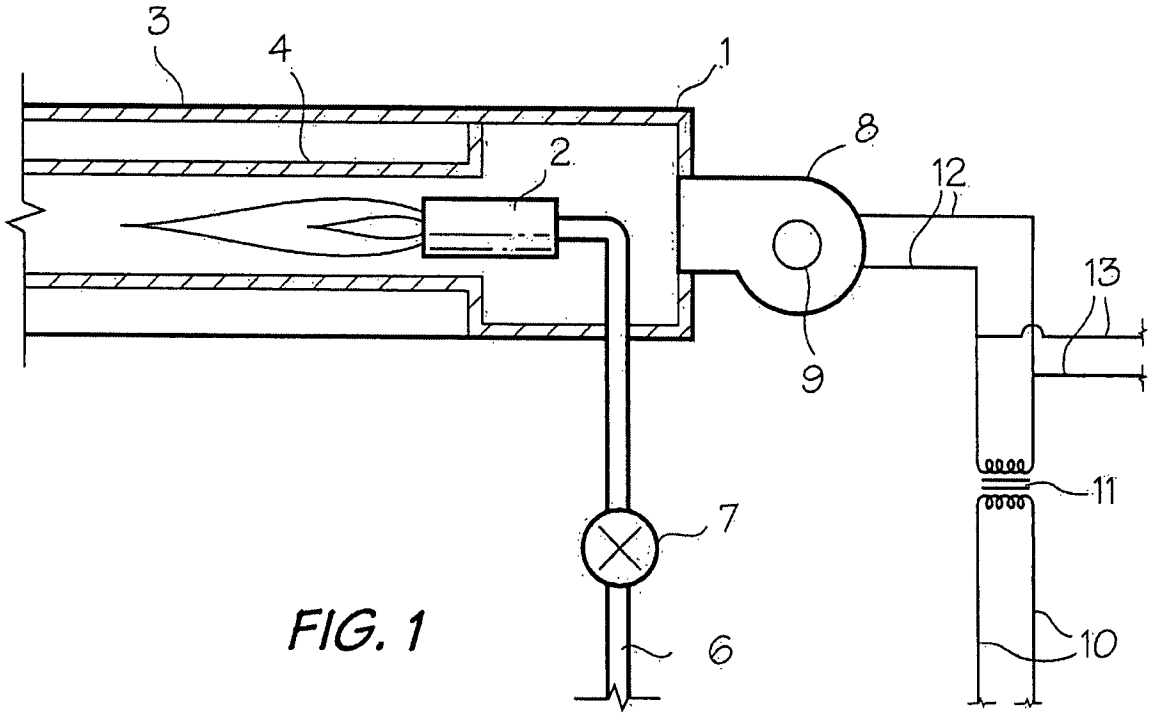
FIG. 1 is a partly sectioned view of the inlet end of a low voltage radiant tube heater in accordance with the present invention.

Referring to FIG. 1, a radiant heater in accordance with the invention includes a housing 1 carrying a burner 2, a reflector 3 and a burner tube 4. Gas is fed into the burner 2 via an inlet line 6 containing a valve 7. Combustion air is fed through one end of the housing 1 into the burner tube 4 by a blower 8. In accordance with a first aspect of the present invention, the motor 9 of the blower 8 is a 24 volt motor. High voltage is fed via lines 10 from a source thereof to a transformer 11, which is mounted on a wall or other location remote from the radiant heater. The transformer 11 is connected to the blower motor by lines 12. Taps 13 can draw low voltage from the lines 12 for feeding current to other low voltage components of a burner assembly.

Figure 2:
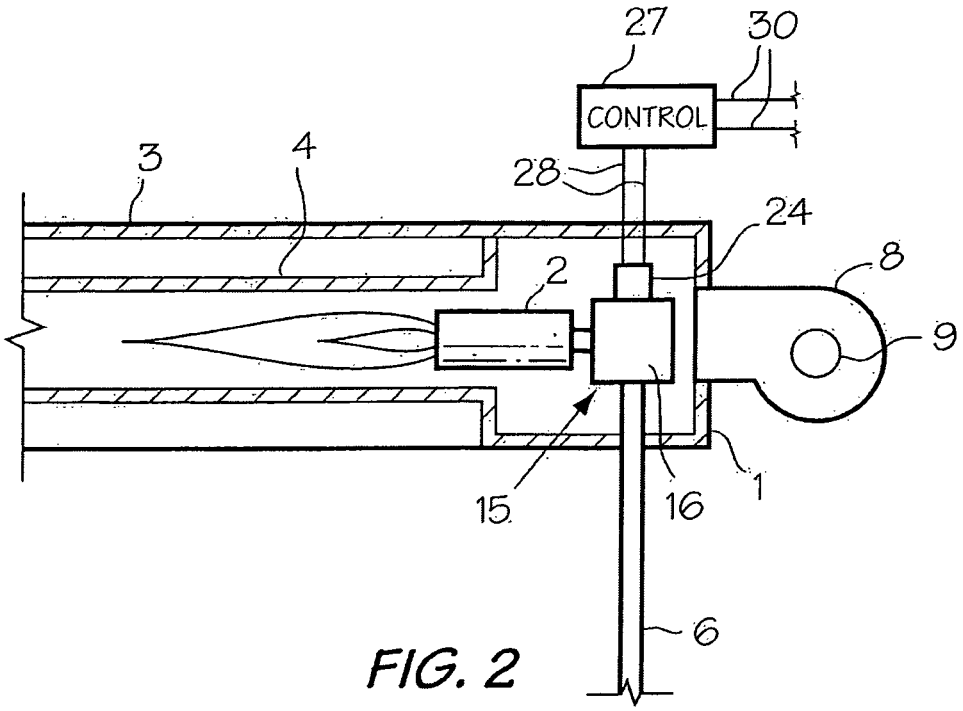
FIG. 2 is a partly sectioned view of the inlet end of a variable gas input radiant tube heater in accordance with the present invention.

With reference to FIG. 2, a variable input, radiant tube heater in accordance with the invention includes most of the basic components of the heater of FIG. 1, namely a housing 1 carrying a burner 2, a reflector 3, a burner tube 4, a gas inlet line 6 and a blower 8. A gas pressure regulator indicated generally at 15 is inserted into the inlet line 6 for regulating the flow of fuel to the burner 2. The pressure regulator 15 can be integral with an on/off gas valve, i.e. both elements can be defined by a single component.

Figure 3:
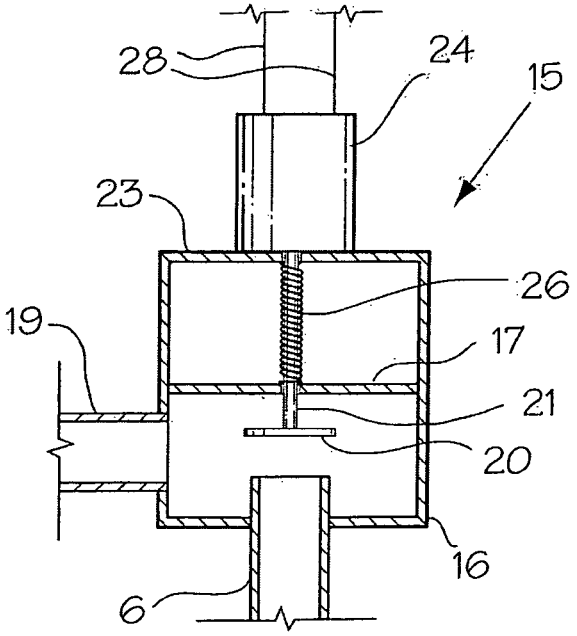
FIG. 3 is a cross-sectional view of a gas inlet housing used in the heater of FIG. 2.

As best shown in FIG. 3, the pressure regulator 15 includes a casing 16 with a resilient partition 17, e.g. a diaphragm extending thereacross. Fuel entering the casing 16 from the inlet line 6 is discharged to the burner 2 via a line 19. The top end of the gas inlet line 6 can be closed by a valve plate 20 mounted on the bottom end of a valve stem 21. The valve stem 21 extends through the partition 17 and the top end 23 of the casing 16 to a valve operator defined by a solenoid or stepper motor 24, which is adapted to move the valve stem 21 and the plate 20 up or down to open and close the valve as well as to regulate the amount of fuel flowing from the top end of the inlet line 6. A helical spring 26 on the valve stem 21 above the partition 17 regulates fuel pressure as it relates to incoming fuel pressure from the line 6. The spring pressure is altered by the solenoid or stepper motor 24 to allow a selected amount of fuel to flow to the burner 2. When a stepper motor is used to cause valve stem movement and/or spring tension, the motor is reversible for opening and closing the valve. Operation of the solenoid or stepper motor 24 is controlled by a control 27 which can be adjusted manually or by means of a thermostat (not shown). The control 27 is connected to the solenoid or stepper motor 24 by lines 28 and to a source of electrical power by lines 30. The solenoid or stepper motor 24 is sensitive to the amount of electrical power it receives. The control 27 employs a rheostat or some type of pulse generator which is manually or automatically (using a thermostat) manipulated.

The above described system is cost effective and easy to produce. The space requirements for components is relatively small, and the components are readily available. Finally, the system is simple to operate.

The support system of the present invention is a modular, track system which is easy to assembly on site, and which can readily be secured to existing patio surfaces using industry standard fasteners.

Figure 4:
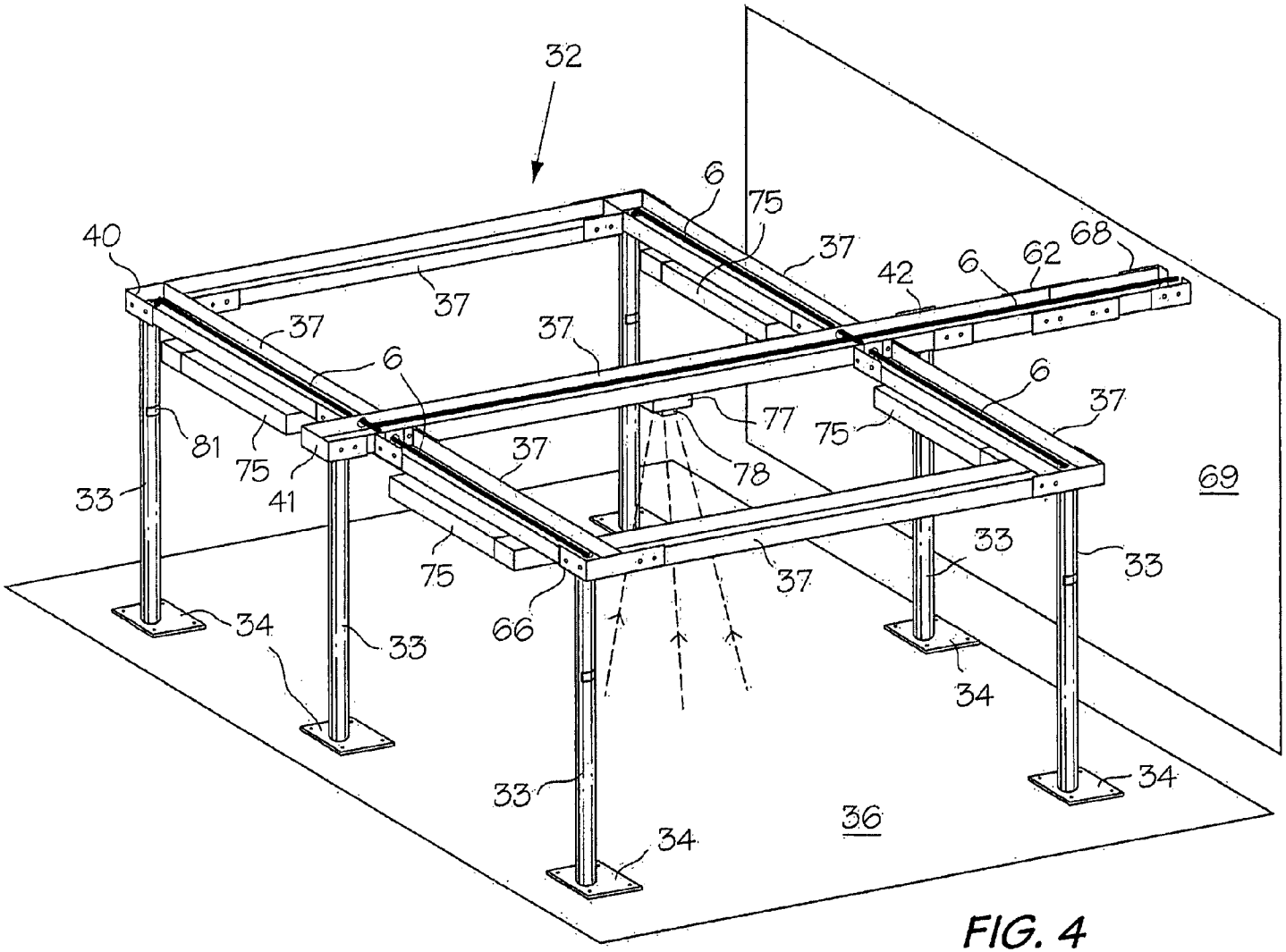
FIG. 4 is a schematic isometric view of a support system for a patio radiant heater assembly with an automatic temperature control in accordance with the present invention.
Figure 5:
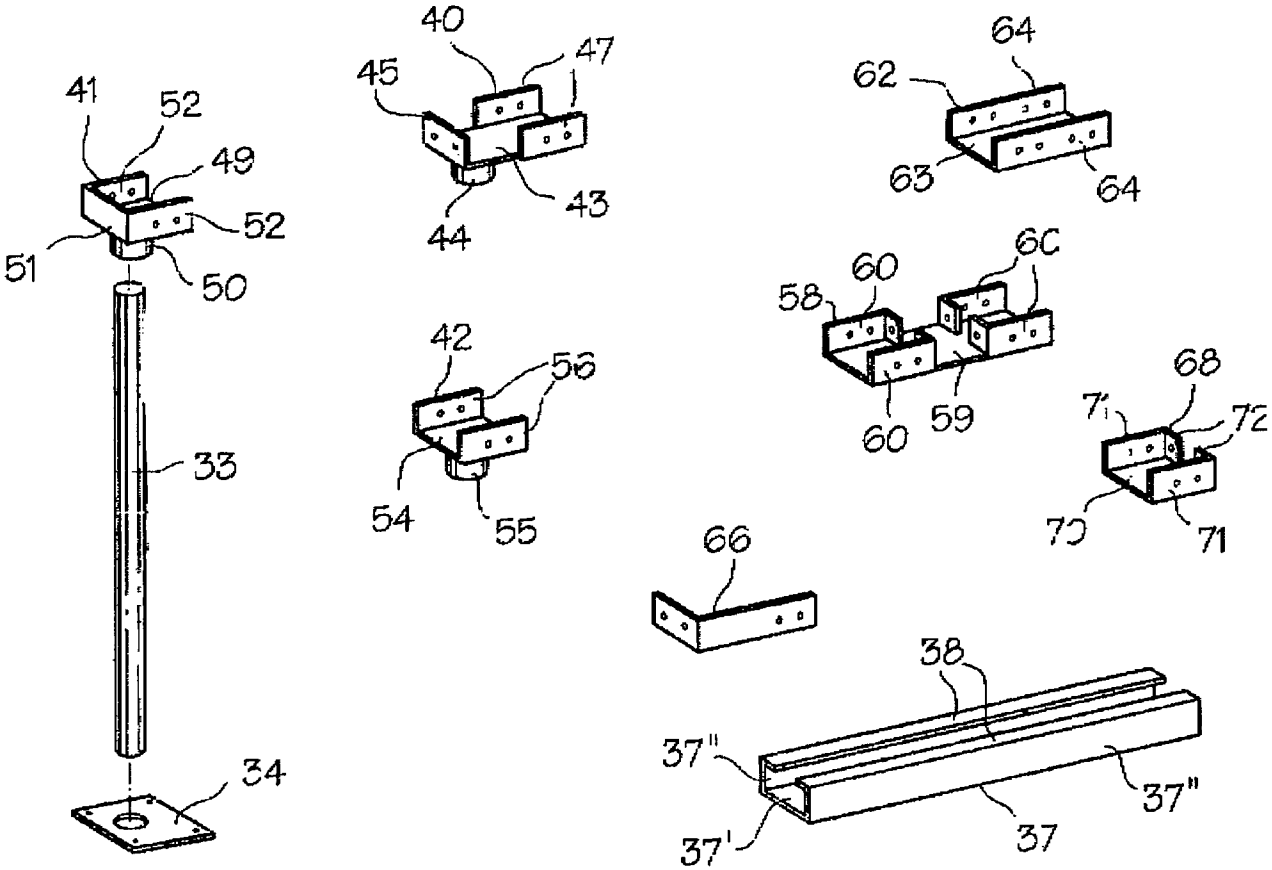
FIG. 5 is a collection of isometric views of elements of the support system of FIG. 4.

Referring to FIGS. 4 and 5, the patio heater support system of the present invention includes a rectangular frame indicated generally at 32 supported by a plurality of posts 33. The posts 33 are mounted on or in baseplates 34 which are bolted or otherwise connected to a patio surface 36. The frame 32 is defined by a plurality of hollow generally U-shaped beams 37 including a bottom wall 37' and side walls 37". The beams 37 may include inwardly extending strengthening flanges 38 (FIG. 5) on the top ends thereof. The beams 37 are connected to the posts 33 by a variety of mounting saddles including end mounting saddles 40 and 41, and intermediate mounting saddles 42.

As best shown in FIG. 5, one form of end mounting saddle 40 includes a bottom plate 43, with a sleeve 44 extending downwardly therefrom for mounting on the top end of a post 33. An end plate 45 is used to connect the saddle to one side of a beam 37. A pair of side plates 47 at the other end of the plate 43 are used to connect the saddle to a second beam 37 perpendicular to the beam connected to the plate 45. Gaps 48 between the end plate 45 and the side plates 47 are adapted to receive the ends of other beams when interconnecting beams perpendicular to each other.

The end mounting saddle 41 includes a bottom plate 49 with a sleeve 50 extending downwardly therefrom, an end plate 51 and a pair of side plates 52. The saddle 41 is used on the end of a central beam 37 when the frame 32 is large enough to require two contiguous, rectangular sections.

The intermediate mounting saddle 42 includes a bottom plate 54, a sleeve 55 extending downwardly from the bottom plate 54 and a pair of side plates 56 for straddling a beam. The saddle 42 is used between the ends of beam 37 for supporting the beam in an elevated position.

A mounting bracket 58 is used to connect a pair of beams 37 end to end on opposite sides of a third beam 37 perpendicular to the first two beams. The bracket 58 includes a baseplate 59 and a pair of L-shaped sides 60 extending inwardly from each end of the baseplate 59 for attachment to a pair of beams 37. A third beam 37 is inserted between the sides 60 perpendicular to beams resting on the baseplate 59 between the ends of such sides 60.

Beams 37 can be spliced end to end using a generally U-shaped splicer 62 defined by a baseplate 63 and a pair of rectangular sides 64. An L-shaped end cap 66 is used to close any open ends of the beams 37 at the corners of the finished frame 32. A bracket 68 is used to connect the free end of a beam 37 to wall 69 of a building or to another vertical structure such as a fence to anchor the support structure in position. The bracket 68 includes a baseplate 70, side walls 71 and short end walls 72. Bolts or screws extend through the end walls 72 into a vertical support structure, and bolts or screws extending through the sidewall 71 connect the bracket to a beam 37 resting on the baseplate 70.

Figure 6:
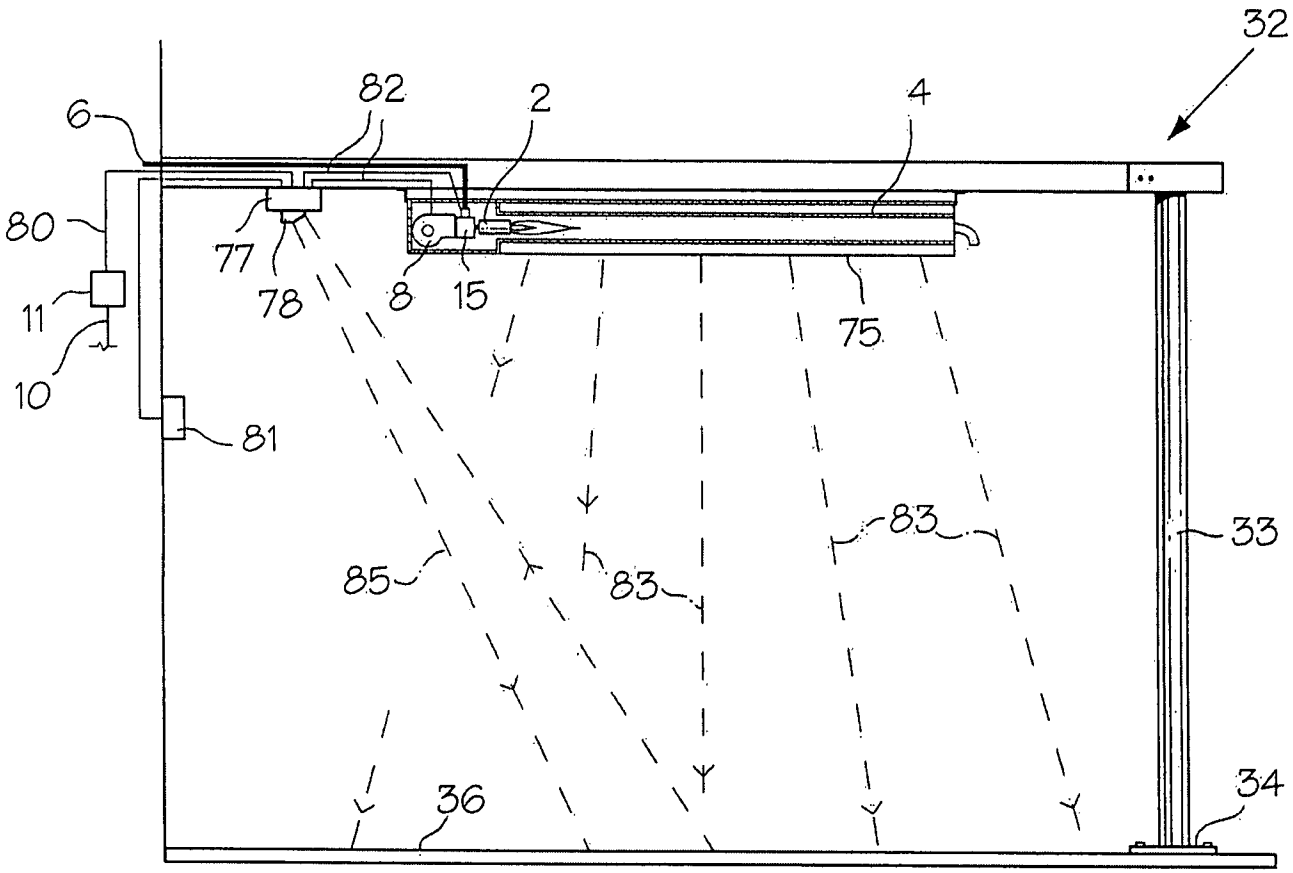
FIG. 6 is a schematic cross-sectional view of a burner and controls for the burner used in the assembly of FIG. 4.

Referring to FIGS. 4 and 6, the beams 37 support a plurality of radiant heaters 75. Gas lines 6 to the heaters are housed in the beams 37, which also carry electrical wires (FIG. 6) for operating the blower 8 and a gas flow regulator 15.

The automatic temperature control system includes a control 77 and an infrared sensor 78 suspended from the center of the frame 32 (FIG. 4). The control 77 and sensor 78 can be mounted at other locations on the frame 32, and more than one sensor could be used. Electrical power for operating the system is fed to the control via lines 10, a transformer 11 and lines 80. The controller 77 is also connected to a remote control panel 81 which can be mounted in a post 33 (FIG. 4). Lines 82 connect the control 77 to the blower 8 and to the gas pressure regulator 15.

In operation, the patio surface 36 is heated by infrared waves 83 (FIG. 6) from the heaters 75. An infrared beam 85 from the sensor 78 is aimed at a target, e.g. the surface 36 of the patio or a table. The reflected beam provides an indication of the temperature of the target, and the control 77 adjusts the flow of current to the blower and to the gas pressure regulator 15 to vary the heat output of the radiant heaters 75.

The invention claimed is:

1. A modular supporting system for outdoor radiant heaters comprising a frame including at least one hollow beam for receiving fuel and electrical lines and supporting a radiant heater; a plurality of posts for supporting said beam at ends thereof; saddles for connecting said beam to said posts, each said saddle having a closed bottom end, side walls and an open top end; at least one infrared sensor for mounting on said frame for detecting an infrared beam reflected from an article beneath the heater; and a control connected to the sensor and heater for adjusting the flow of electrical power and fuel to the heater, whereby the heat output of the radiant heater can be adjusted.

2. The supporting system of claim 1 wherein said saddles and at least one intermediate mounting saddle for use between ends of the hollow beam for connecting the beam to a post, said intermediate mounting saddle including a bottom plate, a sleeve extending downwardly from the bottom plate for mounting the intermediate saddle on a post, a pair of opposed side plates for straddling a beam and an open top end for receiving the beam.

3. The support system of claim 1, including gaps between said side and end plates of said end mounting saddle for receiving an end of at least one other hollow beam to interconnect hollow beams perpendicular to each other.

4. The supporting system of claim 2, wherein said intermediate saddle includes a bottom plate, a sleeve extending downwardly from said bottom plate for mounting the intermediate saddle on a post, and a pair of side plates for straddling a beam or opposed ends of a pair of beams.

5. The supporting system of claim 1, including a bracket for connecting an end of a beam to a vertical structure, said bracket including a bottom wall, a pair of side walls and an end wall.

6. The supporting system of claim 1, wherein said hollow beam includes a bottom wall, a pair of side walls, and opposed inwardly extending strengthening flanges on top ends of said side walls.

* * * * *